United States Patent [19]

Nelson

[11] 3,947,913

[45] Apr. 6, 1976

[54] COMBINES MOP OR BROOM AND SCRAPER

[76] Inventor: Ethelyn B. Nelson, 6410 Maiden Lane, Bethesda, Md. 20034

[22] Filed: Aug. 22, 1974

[21] Appl. No.: 499,850

[52] U.S. Cl. ..... 15/111; 15/118; 15/236 R; 248/359

[51] Int. Cl.[2] ..... A46B 17/08; A47L 13/12

[58] Field of Search ..... 15/104.01 R, 105, 111, 15/113, 118, 236 R; 30/130; 211/66; 294/50.7; D7/181–184

[56] References Cited

UNITED STATES PATENTS

| | | | |
|---|---|---|---|
| 235,999 | 12/1880 | Coyle | 15/105 |
| 412,002 | 10/1889 | Schroen | 15/236 UX |
| 1,018,518 | 2/1912 | Pettit | 15/236 R X |
| 1,051,175 | 1/1913 | Thompson | 30/130 |
| 1,387,414 | 8/1921 | La Voie | 15/104.01 R |
| 1,483,760 | 2/1924 | Yoshizawa | 15/111 |
| 2,574,654 | 11/1951 | Moore | 15/111 X |
| 3,036,322 | 5/1962 | Jorgensen | 15/236 X |
| D34,656 | 6/1901 | Seck | D7/184 X |
| D212,873 | 12/1968 | White | D9/258 |

FOREIGN PATENTS OR APPLICATIONS

| | | | |
|---|---|---|---|
| 312,965 | 6/1919 | Germany | 15/236 R |
| 1,232,547 | 1/1967 | Germany | 15/105 |

*Primary Examiner*—Daniel Blum
*Attorney, Agent, or Firm*—Cushman, Darby and Cushman

[57] ABSTRACT

A cleaning implement having a scraper attachment and said attachment are disclosed. The scraper preferably includes a generally cylindrical or rectangular prism extension of the handle of the cleaning implement mounted at the free end thereof opposite the end to which a cleaning device is attached. The top edge of the extension is serrated, providing an effective scraping surface. A means associated with the scraper facilitates hanging of the implement upon a hook or nail.

1 Claim, 2 Drawing Figures

COMBINES MOP OR BROOM AND SCRAPER

BACKGROUND AND SUMMARY OF THE INVENTION

The invention relates to cleaning implements, such as brooms and mops, having scraper attachments thereon, and to such scraper attachments. In the past there have been many suggestions for cleaning implements with scrapers thereon for scraping materials off of surfaces which cannot be removed by the cleaning end of the implement itself, such as those shown in U.S. Pat. Nos. 412,002 and 668,160. While such means are generally satisfactory, they often confront the problems of making the cleaning implement unwieldy, and providing a dangerous surface on which the user or another might injure themselves, and they provide no ready means for storage of the device, damage sometimes ensuing to walls or doors etc. if the scraper should lean against them or fall against them at some time during storage. Effective means for hanging a cleaning implement, such as shown in U.S. Pat. No. 538,269 have not been provided that prevent scraper damage, nor have scrapers that do not have surfaces thereof that have a relatively large probability of causing damage or making a device unwieldy (see U.S. Pat. No. 1,387,414) been attached to cleaning implements.

According to the teachings of the present invention, a cleaning implement is provided having one cleaning end and a scraper attached at the other end thereof. The scraper outside surface is only of slightly larger dimensions than the cleaning implement handle and extends only slightly therepast longitudinally so that it does not make the implement unwieldy or have much potential for causing damage to the user. In addition, the scraping surface — while very effective for scraping materials off of surfaces — does not have portions thereof that have great potential for causing human or fixture damage nor does the material of which the scraper is made. In addition, means are provided directly associated with the scraper — such as a notch therein — for allowing hanging of the scraper up on a hook so that it is not necessary to have it lean against a wall or be placed on the floor, and at the same time the general configuration of the scraper lends itself to being hung on a hook or the like without causing instability of the hanging implement.

It is the primary object of this invention to provide an improved cleaning implement with a scraper attached thereto and scraper therefor. This and other objects of the invention will become clear from an inspection of the detailed description of the invention and the appended claims.

DETAILED DESCRIPTION OF THE INVENTION

Figure 1:
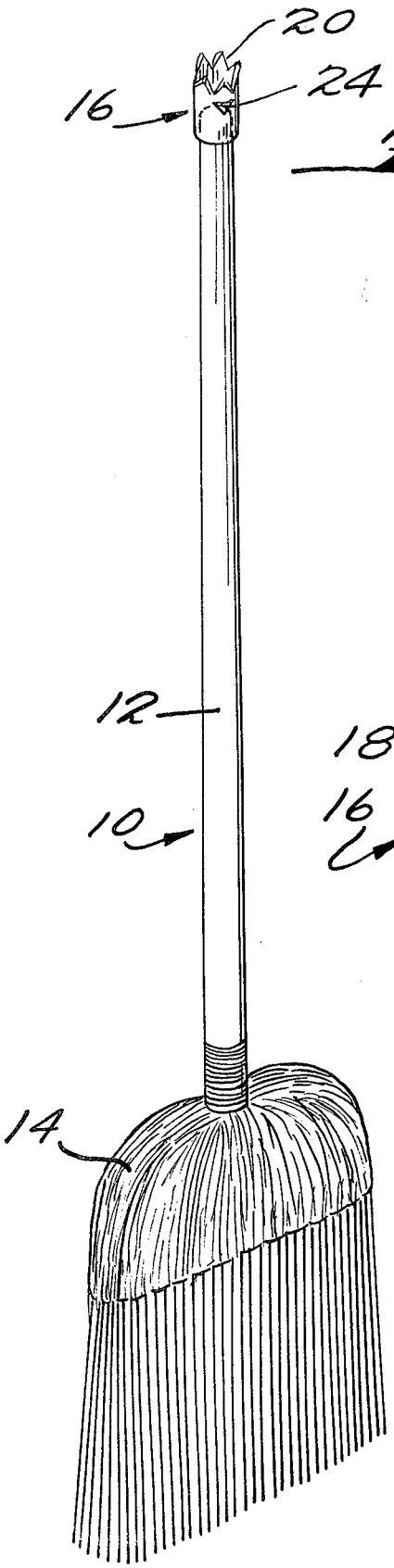
FIG. 1 is a perspective view of an exemplary cleaning implement with a scraper on the end thereof opposite the cleaning surface, according to the present invention.

A cleaning implement incorporating the teachings of the present invention is shown generally at 10 in FIG. 1. The implement may be a mop, a broom (as shown), a dust mop, or any other similar cleaning implement having a cleaning end and a relatively elongated handle. The implement 10 comprises a handle 12, having a cleaning device or portion — such as broom 14 — at one end thereof, and having a scraper, shown generally at 16, at the other end thereof. The scraper 16 is preferably made out of durable relatively hard plastic — such as polystyrene, ABS terpolymer, or polyphenyleneether or hard rubber. However, the plastic should not be so hard that it would scratch tile, wood, or other common surfaces upon which it was used.

Figure 2:
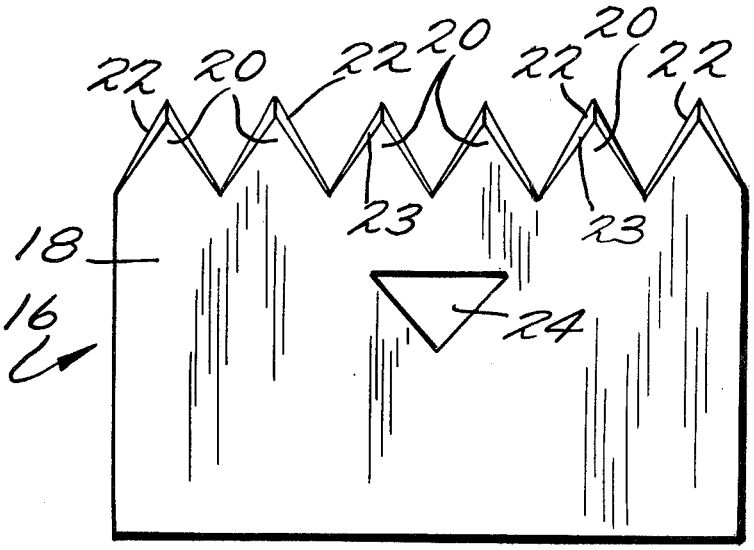
FIG. 2 is a plan view of a blank before it is formed into an exemplary scraper according to the present invention.

A blank for forming a scraper 16 is shown in FIG. 2. While the scraper 16 may be formed of a blank and then joined at either longitudinal ends, it could also be formed as an integral piece, and for many uses this would be preferred. The scraper 16 has a body portion 18 with sawtooth projections 20 extending from the top thereof forming a serrated border or edge. Each of the sawtooth projections 20 is adapted individually and in combination to scrape materials off of surfaces, and they may be bevelled from the interior of the cylinder outwardly, as shown at 23. Note however, that when the scraper is attached on the end of a handle as shown in FIG. 1, there are no portions thereof much wider or having a significantly different shape or dimension from the handle 12 itself, thus minimizing the surface area that will be presented that might cause human injury and preventing the handle 12 from becoming unwieldly, while still providing an effective scraping means since the scraping area is generally defined by the inclined walls 22 defining each sawtooth 20 as well as the sawtooth tip itself.

The scraper 16 is formed into a closed cylinder (or rectangular prism) when attached to the handle 12, the inside diameter of the cylinder being substantially the same as the outside diameter of the handle 12. Or if the handle 12 and scraper 16 are formed of the same material, the scraper can be produced as an integral extension of the handle having the same diameter. Thus no portion of the scraper 16 extends very much outwardly from the handle 12 perpendicular to a plane containing the handle 12.

Associated with the scraper 16 is a means 24 for facilitating hanging of the scraper and cleaning implement 10 incorporating it on a nail, hook, or the like. Note that the generally cylindrical (or rectangular prismatic) shape of the scraper 16 facilitates hanging thereof without the scraper causing unbalance. As shown in the drawings, the hanging facilitating means comprises a notch 24 formed in the body 18 of scraper 16, said notch preferably being located closer to the sawteeth 20 than the bottom of the body 18.

Attachment of the scraper 16 to the end of a handle 12 may be effected by any suitable means such as glue, a screw, or the like. Attachment of scraper 16 to handle 12 can be made permanent or easily removable. Preferably, the scraper is attached to the handle 12 so that the notch 24 in the scraper 16 is located above the top of the handle 12. In this way the implement can be securely hung by the scraper 16, a nail, hook, or the like having a portion thereof extending through the notch 24 into the area bounded by the scraper walls. Also, it is preferable that the notch 24 be aligned so that it is in a plane parallel to the largest longitudinal dimension of the cleaning portion 14 of the implement, for ease of hanging.

It will thus be seen that a scraper has been provided that may be readily attached to any cleaning implement, such as a broom or mop or the like, and that when the implement is used for cleaning the scraper will not make the implement unwieldy, nor will it present great potential for human injury. By the same token, when the cleaning portion 14 of the implement 10 is not used, the scraper 16 can effectively scrape materials off surfaces.

While the invention has been herein illustrated in what is presently conceived to be the most preferred and practical embodiment, it will be apparent that many modifications may be made thereof within the scope of the invention, which scope is not to be limited except by the appended claims.

What is claimed is:

1. A cleaning implement comprising a. an elongated cylindrical handle having two free ends thereof, b. a cleaning device attached at one of said handle free ends, said cleaning device comprising a mop head, or broom bristles, c. means for scraping hard to remove materials from surfaces to be cleaned while not making said implement unwieldy when used for mopping or sweeping and for allowing various orientations of said handle during scraping, said means mounted at the free end of said handle opposite the end of said handle said cleaning device is attached to and comprising (i) a generally elongated tubular extension, of substantially constant cross-section, of said handle having the same shape cross-section as the cross-section of said handle and having an inside circumference corresponding to the outside circumference of said handle and an outside circumference only slightly greater than the outside circumference of said handle, said extension having two ends and being attached to said handle at one end of said extension, (ii) a serrated peripheral edge defining the circumferential terminating edge of the end of said extension opposite the end thereof attached to said handle, and (iii) said extension formed of an integral piece of plastic, said plastic being hard enough to remove materials stuck to surfaces, but not being hard enough to mark or scratch said surfaces, and d. a notch formed in said tubular extension at a portion thereof spaced from the furthestmost longitudinal extent of said handle for facilitating hanging of said cleaning implement upon a hook or the like.

* * * * *

UNITED STATES PATENT OFFICE

CERTIFICATE OF CORRECTION

Patent No. 3,947,913 Dated April 6, 1976

Inventor(s) Ethelyn B. (Mrs.) NELSON

It is certified that error appears in the above-identified patent and that said Letters Patent are hereby corrected as shown below:

In the patent heading, line (54), and in column 1, line 2, the title should be listed as follows:

--COMBINED MOP OR BROOM AND SCRAPER--

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*